US006116518A

United States Patent [19]

Negrini et al.

[11] Patent Number: 6,116,518

[45] Date of Patent: Sep. 12, 2000

[54] SPRAY GUMMING UNIT

[75] Inventors: Fausto Negrini, Castelfranco Emilia; Marco Majoli, S. Giovanni in Persiceto; Antonio Valentini, S. Lazzaro di Savena; Marco Brizzi, Zola Predosa, all of Italy

[73] Assignee: G.D S.p.A., Bologna, Italy

[21] Appl. No.: 09/178,609

[22] Filed: Oct. 26, 1998

[30] Foreign Application Priority Data

Oct. 27, 1997 [IT] Italy ..... BO97A0639

[51] Int. Cl.[7] ..... B05B 15/02; F23D 11/34; F23D 11/38; F23D 14/50

[52] U.S. Cl. ..... 239/112

[58] Field of Search ..... 239/104, 106, 239/112, 114, 115; 118/676, 678, 683, 684, 313, 325

[56] References Cited

U.S. PATENT DOCUMENTS

| | | | |
|---|---|---|---|
| 4,387,002 | 6/1983 | Knecht | 156/578 |
| 5,065,692 | 11/1991 | Hollesen et al. | 18/302 |
| 5,226,565 | 7/1993 | Hladis et al. | 239/112 |
| 5,344,073 | 9/1994 | Waryu et al. | 239/112 |
| 5,842,641 | 12/1999 | Mazzalveri | 239/104 |

FOREIGN PATENT DOCUMENTS

| | | |
|---|---|---|
| 0486159 | 5/1992 | European Pat. Off. . |
| 486 159 A1 | 5/1992 | European Pat. Off. . |
| 3908453 | 6/1990 | Germany . |
| 39 08 453 A1 | 9/1990 | Germany . |
| 39 15 549 A1 | 11/1990 | Germany . |
| 3915549 | 11/1990 | Germany . |
| 41 13 445 A1 | 10/1991 | Germany . |
| 4113445 | 10/1991 | Germany . |

OTHER PUBLICATIONS

Patent Abstracts of Japan, vol. 014, No. 020, (C–676), Jan. 17, 1989 & JP 01 262964 A.

Patent Abstracts of Japan, vol. 014, No. 020 (c–676), Jan. 17 1989 & JP 01 262964 A, (Hitachi Ltd), Oct. 19 1989.

*Primary Examiner*—Andres Kashnikow
*Assistant Examiner*—Davis Hwu
*Attorney, Agent, or Firm*—Pillsbury Madison & Sutro LLP

[57] ABSTRACT

The invention relates to a spray gumming unit where, during stops in gumming operations, a shutter element for the ejectors of spray gummers moves away from and towards the ejectors between an ejectors closed position in which a pad fixed to an end of the shutter element is in contact with the ejectors and an ejectors open position in which a nebulized liquid substance is sprayed on the pad to wet and/or clean the pad itself.

4 Claims, 1 Drawing Sheet

FIG. 2
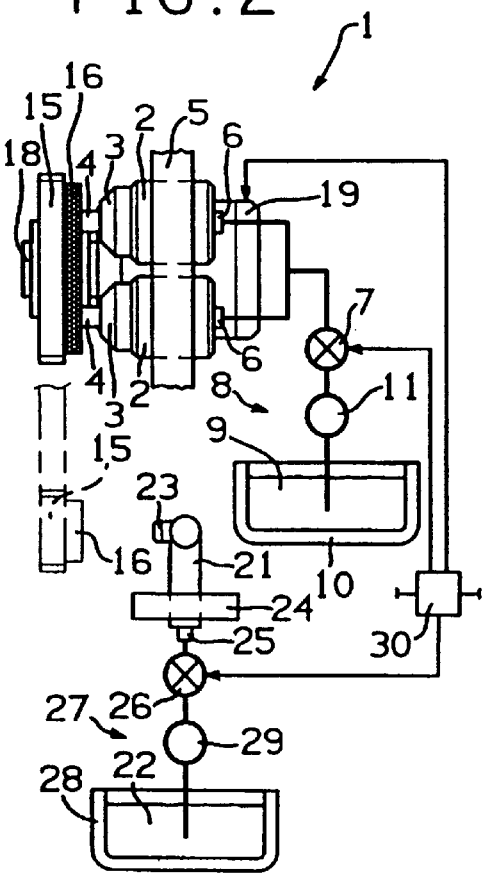
FIG. 1
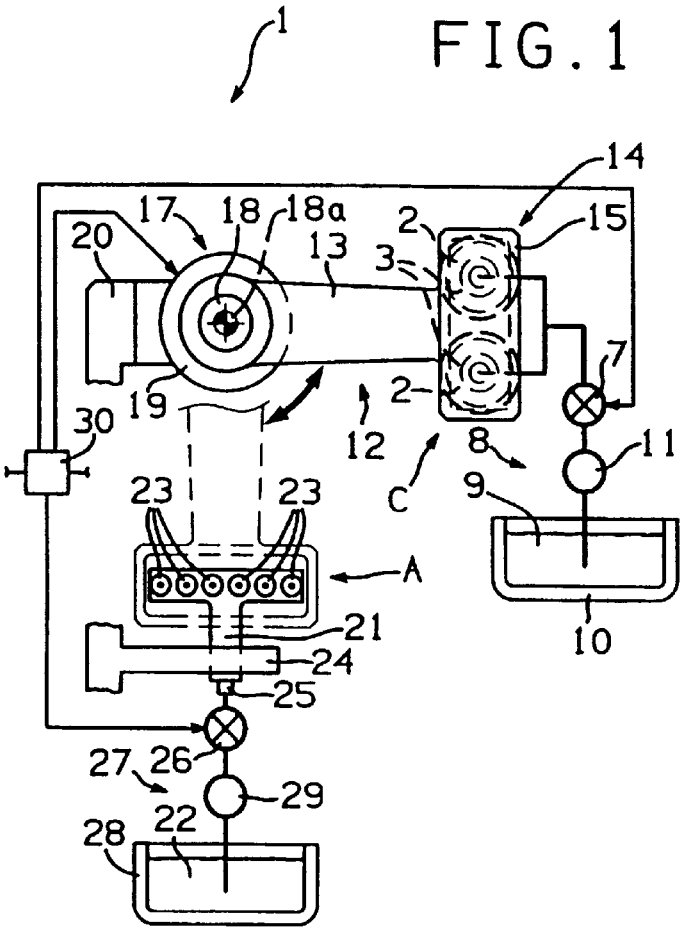
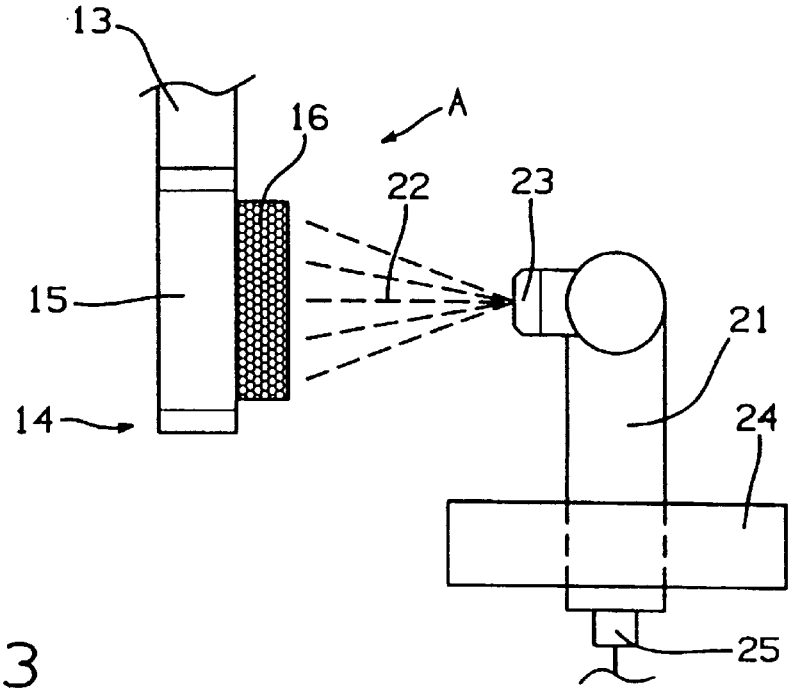
FIG. 3

SPRAY GUMMING UNIT

BACKGROUND OF THE INVENTION

The present invention relates to a spray gumming unit.

The invention can be used to good advantage in the field of packaging machinery, especially packing machines, to which the description below refers but without thereby restricting the scope of the invention.

In these machines, an adhesive substance must be applied to certain parts of paper sheets, such as blanks, for example, designed to be folded into containers or packets, or labels to be applied to the containers or packets.

Packing machines are known to be equipped with spray gumming units facing the line along which the paper sheets to be gummed are fed, each unit comprising at least one spray gummer whose gumming nozzle is connected to an adhesive feed system and is equipped with an adhesive ejector.

The disadvantage of spray gumming units of this type is that the gumming nozzle ejectors require frequent cleaning and maintenance, mainly because part of the adhesive dries on the ejectors when the packing machine is stopped for short periods.

An object of the present invention is to provide a spray gumming unit that overcomes the disadvantage just described.

SUMMARY OF THE INVENTION

The present invention provides a spray gumming unit comprising an adhesive feed system and at least one spray gummer with a gumming nozzle equipped with an ejector for the adhesive itself, the unit being characterized in that it also comprises shutter means to close the ejector during stops in gumming operations, the shutter means being capable of moving, during the stops, away from and towards the ejector between a position in which the ejector is open to one in which it is closed; motor means to move the shutter means to and from the open and closed positions; and means for cleaning the shutter means when they are in the open position.

Preferably, the shutter means comprise a supporting element designed to move to and from the open and closed positions; there being connected to a portion of the supporting element means to support a pad, which, in the closed position, is in contact with and closes the ejector and, in the open position, can be cleaned by the above mentioned cleaning means.

BRIEF DESCRIPTION OF THE DRAWINGS

The invention will now be described with reference to the accompanying drawings which illustrate a preferred embodiment of the invention and in which:

FIG. 1 is a front elevation view, with some parts cut away in order to better illustrate others of a preferred embodiment of the spray gumming unit made according to the present invention;

FIG. 2 is a side view of the unit illustrated in FIG. 1; and

FIG. 3 is an enlarged detail of a part of FIG. 2.

DESCRIPTION OF THE PREFERRED EMBODIMENTS

With reference to FIGS. 1 and 2, the numeral 1 indicates a spray gumming unit comprising two spray gummers 2, each having a gumming nozzle 3 equipped with an ejector 4 facing a line (not illustrated) along which sheets of paper to be gummed (not illustrated) are fed.

As shown in FIG. 2, the gummers 2 are mounted by a bracket 5 and each has an infeed pipe 6 connected through a valve 7 to an adhesive 9 feed system 8, the adhesive being contained in a tank 10 and delivered by a pump 11.

As illustrated in FIG. 1, the unit 1 also comprises a shutter device 12 which in turn comprises a supporting element consisting of a rod 13, a portion of which, consisting of an end 14, is rigidly connected to a plate 15 which mounts a pad 16, made preferably of sponge, and whose opposite end 17 is keyed to a shaft 18 of a reversible motor 19 mounted in a fixed position by a bracket 20.

The motor 19 is driven in such a way as to swing the rod 13, clockwise and counterclockwise in FIG. 1, about the axis 18*a* of the shaft 18, away from and towards the ejectors 4, from an open position A, illustrated as a dashed line in FIG. 1, in which the plate 15 is located on one side of the ejectors 4, and a closed position C, illustrated as a continuous line in FIG. 1, in which the plate 15 is face to face with the nozzles 3 with the pad 16 in contact with the ejectors 4 and closing the ejectors 4 themselves.

As shown in FIGS. 1 and 3, the unit 1 also comprises a device 21 that supplies a liquid substance 22, for example, water or solvent, and that comprises a battery of nebulizing nozzles 23. The nozzles 23 are placed face to face with the plate 15 in position A, and are designed to spray the substance 2 onto the pad 16, thus wetting the pad 16 and cleaning it.

The spray device 21 is mounted by a bracket 24 and has an infeed pipe 25 connected through a valve 26 to a system 27 that feeds the liquid substance 22, the liquid substance being contained in a tank 28 and delivered by a pump 29.

Lastly, the unit 1 comprises a control unit 30, which, when the unit 1 is not operating, controls the drive of the motor 19 of the valve 7 of the adhesive 9 feed system 8 and of the valve 26 of the liquid system 22 feed system 27.

During a normal operating cycle of the gumming unit 1, the rod 13 of the shutter device 12 is in the open position A and the control unit 30 receives a signal each time a sheet of paper to be gummed passes in front of the ejectors 4 of the gummers 2 and opens the valve 7 to allow the adhesive 9 to be sprayed out of the ejectors 4.

If operation is stopped, the control unit 30 closes the valve 7, thus cutting off the supply of adhesive 9, and opens the valve 26 of the liquid 22 feed system 27 so that jets of nebulized liquid 22 are sprayed out of the nozzles 23 and wet the pad 16.

At this point, after closing the valve 26, the control unit 30 activates the motor 19, thus swinging the rod 13 from position A to position C so that the pad 16, wetted by the liquid 22, moves into contact with the ejectors 4 and the latter are closed by the pad 16.

Note that when the pad 16, wetted by the liquid 22, is in contact with the ejectors 4, it prevents the adhesive 9 from drying on and clogging the ejectors 4.

When the operating cycle is resumed, before the adhesive 9 starts being fed to the gummers 2 again, the control unit 30 drives the motor 19 so as to move the rod 13 to position a and opens the valve 27 so that the pad 16 is again sprayed with nebulized liquid 22 to clean the pad 16 once again.

What is claimed:

1. A spray gumming unit comprising:

a feeder which feeds an adhesive substance;

at least one spray gummer having a gumming nozzle, the gumming nozzle having an ejector, constructed and arranged to receive the adhesive substance from the feeder and to eject the adhesive substance from the gummer;

a shutter, the shutter being movable between a closed position and an open position, and constructed and arranged to be in contact with and to close the ejector during stops in gumming operations when in the closed position;

a motor which actuates the shutter, moving it between the closed position and the open position; and a cleaner, constructed and arranged to clean the shutter when it is in the open position.

2. A spray gumming unit according to claim 1, wherein the shutter further comprises:

a supporting element, actuated by the motor and movable between the closed position and the open position; and a pad, mounted on the supporting element, the pad being in contact with and closing the ejector when the shutter is in the closed position and being cleaned by the cleaner when the shutter is in the open position.

3. A spray gumming unit comprising:

a system for feeding an adhesive substance;

at least one spray gummer having a gumming nozzle, the gumming nozzle having an ejector, constructed and arranged to eject the adhesive substance from the gummer;

a shutter, the shutter being movable between a closed position and an open position, constructed and arranged to close the ejector during stops in gumming operations when in the closed position, the shutter further comprising:

a supporting element, actuated by a motor and movable between the closed position and the open position; and a pad, mounted on the supporting element, the pad being in contact with and closing the ejector when the shutter is in the closed position and being cleaned by a cleaner when the shutter is in the open position, wherein the cleaner comprises a sprayer, constructed and arranged to spray liquid onto the pad.

4. A spray gumming unit as recited in claim 3, wherein the sprayer further comprises a nebulizer which sprays the liquid onto the pad.

* * * * *